US007412854B2

(12) United States Patent
Raemisch et al.

(10) Patent No.: US 7,412,854 B2
(45) Date of Patent: Aug. 19, 2008

(54) LIGHTWEIGHT CABLE LOCK

(76) Inventors: Richard Raemisch, 5102 Reynolds Ave., Waunakee, WI (US) 53597; Andrea Roloff, 5331 Robinson Rd., Floodwood, MN (US) 55736

( * ) Notice: Subject to any disclaimer, the term of this patent is extended or adjusted under 35 U.S.C. 154(b) by 322 days.

(21) Appl. No.: 11/235,608

(22) Filed: Sep. 27, 2005

(65) Prior Publication Data

US 2007/0068200 A1 Mar. 29, 2007

(51) Int. Cl.
*E05B 37/02* (2006.01)

(52) U.S. Cl. ..... 70/30; 70/49; 70/312

(58) Field of Classification Search ..... 70/30, 70/49, 20, 26, 312, 23, 22, 315–318, DIG. 44
See application file for complete search history.

(56) References Cited

U.S. PATENT DOCUMENTS 3,950,972 A * 4/1976 Bleier et al. ..... 70/234
4,086,795 A * 5/1978 Foster et al. ..... 70/233
4,177,541 A * 12/1979 Seakan ..... 24/298
4,502,305 A 3/1985 Bakker
5,755,121 A 5/1998 Crass
5,819,560 A 10/1998 Grahovec et al.
5,899,099 A * 5/1999 Tsai ..... 70/26
6,146,049 A * 11/2000 Faris ..... 403/326
6,209,368 B1 * 4/2001 Lee ..... 70/312
6,305,199 B1 * 10/2001 Igelmund ..... 70/58
6,386,005 B1 * 5/2002 Kuo ..... 70/28
6,401,501 B1 6/2002 Kajuch et al.
6,711,922 B1 * 3/2004 Tsai ..... 70/312
6,799,446 B1 * 10/2004 Tsai ..... 70/30
6,860,126 B2 * 3/2005 Ling ..... 70/30
2004/0055343 A1 * 3/2004 Mahre et al. ..... 70/58
2004/0079122 A1 * 4/2004 Tsai ..... 70/30
2004/0154358 A1 * 8/2004 Yu ..... 70/30
2004/0231376 A1 * 11/2004 Leyden et al. ..... 70/58

* cited by examiner

*Primary Examiner*—Lloyd A. Gall
(74) *Attorney, Agent, or Firm*—Michael Best & Friedrich LLP

(57) ABSTRACT

A cable padlock having a thin flexible cable, with a key attached to one cable end and a locking mechanism for receiving and securing the key attached to the other cable end, preferably of a combination or permutation type. The key and locking mechanism are constructed of lightweight materials such as aluminum, providing for a lightweight, compact, and potentially inexpensive padlock. A mechanism for detaching the cable from the locking mechanism by application of a master key is provided to allow an administrator of a facility utilizing a number of the locks to remove each lock without needing to lookup each lock's unique combination. The lock is accordingly useful in prisons, institutions, and other secured facilities where there are concerns that a traditional heavier lock could be used as a makeshift weapon.

9 Claims, 12 Drawing Sheets

DETAIL A

Section A-A

SECTION A-A

DETAIL A

LIGHTWEIGHT CABLE LOCK

STATEMENT REGARDING FEDERALLY SPONSORED RESEARCH OR DEVELOPMENT

Not applicable.

BACKGROUND OF THE INVENTION

1. Field of the Invention

The present invention relates to cable locks, and particularly to cable locks used in secure facilities where there is a risk of residents utilizing heavy, portable objects as weapons.

2. Description of the Prior Art

Secure institutions such as prisons, schools, and hospitals often have means for residents to store personal property, such as lockers, storage cabinets, or foot lockers. These storage facilities are typically secured by using a padlock of some sort, operable either by key or combination. The locks most commonly employed at present are constructed primarily from hardened steel, which increases the weight of the padlocks, and results in a rigid structure. One popular model weighs close to six ounces despite being less than three inches in length. This poses a security problem itself: the relatively heavy weight and rigid structure of the locks allows them to be effectively used as weapons by residents, either as a projectile or by placing the lock inside a sock to form a makeshift bludgeon.

A cable lock, with its flexible cable, greatly reduces the rigid structure of a traditional padlock and thus reduces the potential for injury if the lock is used as a projectile. Combination-operated cable locks are known in the prior art, being typically utilized to temporarily secure bicycles and other moveable objects to a stationary object. However, such locks typically have cables or chains several feet in length and of at least ¼" in diameter to accommodate a variety of objects being secured, and to enable such objects to be secured to stationary objects of varying size and shape. The length and diameter of these cables renders them heavy and typically impractical or unusable for securing lockers and other containers in institutional settings such as prisons, schools, and hospitals.

Alternatively, lightweight cable locks having a rigid plastic body are known in the prior art, and are typically used by travelers to secure luggage. Such locks may have a significant length of retractable cable, which poses its own danger in an institutional setting as a weapon. Furthermore, the plastic bodies of these locks are not usually impact or tamper resistant, which diminishes their security.

U.S. Pat. No. 5,819,560 illustrates a padlock possessing a composite plastic body, which reduces weight. However, the padlock still possesses a rigid structure by virtue of its hardened steel and dense plastic structure, which increases the risk of injury if the lock is thrown. It also is key-operated, which present the added problem of keys that secured residents have to keep, with the risks of loss or theft.

BRIEF SUMMARY OF THE INVENTION

The present invention summarized is a locking device consisting of a flexible cable of small diameter and short length, attached at one end to a locking mechanism of a combination or permutation type capable of being engineered smaller and lighter than the combination locking mechanisms typically found in prior art cable bicycle locks. The other cable end is attached to a key designed to be received and secured into the locking mechanism. The key and locking mechanism are fabricated from a lightweight material, such as aluminum or titanium, and preferably in a relatively simple mechanical fashion to ensure light weight, while retaining strength, security, and reliability. The cable is made of a flexible material of high tensile strength that is cut-resistant, such as braided or twisted steel strands, as is well known in the art, and may be coated with a durable plastic sheath such as vinyl or PVC to further protect the cable. Additionally, the locking mechanism is designed to accept a master key, which enables the administrator of an institution that the locking device is ideally suited for to unlock any lock on the premises without needing to know each individual lock's unique combination.

In the preferred embodiment, the locking mechanism consists of a hollow cylinder surrounded by a series of numbered, notched dials. The key has arranged along its length a series of locking lugs corresponding to each of the numbered dials. To close and secure the lock the numbered dials are aligned to a preset combination, the key is inserted into the hollow cylinder, and is finally secured into the body of the lock when the numbered dials are aligned to any combination other than the preset.

It is an object of the invention to provide a reasonably strong and secure padlock for use primarily by patients, residents, or incarcerated inmates in an institutional setting which will allow residents to secure their property. It is a further object of the invention to provide a padlock that is small enough and light enough so that it is not practically useful as a weapon.

DETAILED DESCRIPTION OF THE INVENTION

Figure 1A:
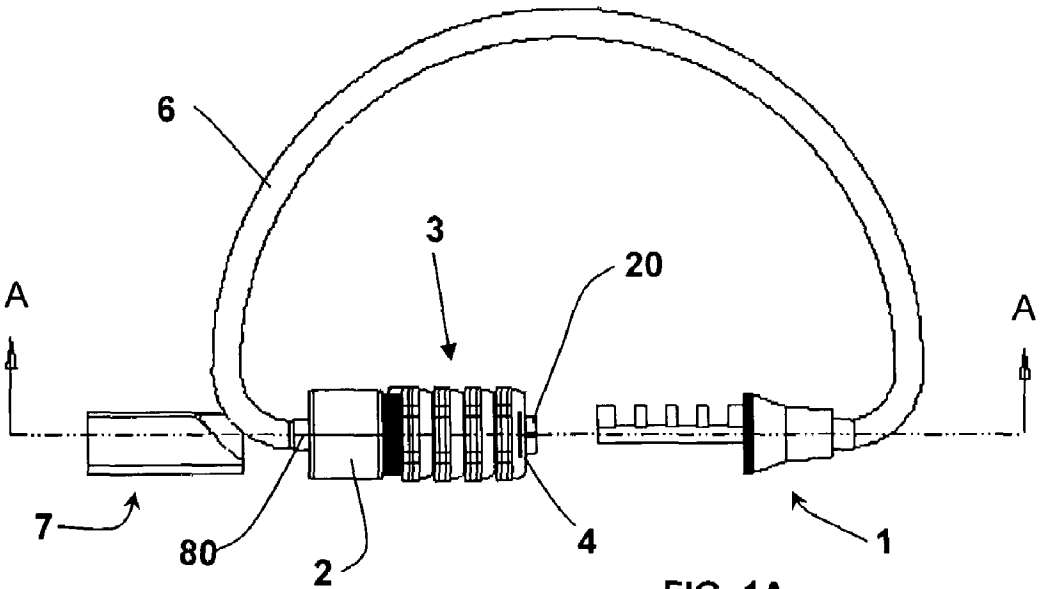
FIG. 1A is a perspective view of a lock as constructed according to the present invention.
Figure 1B:
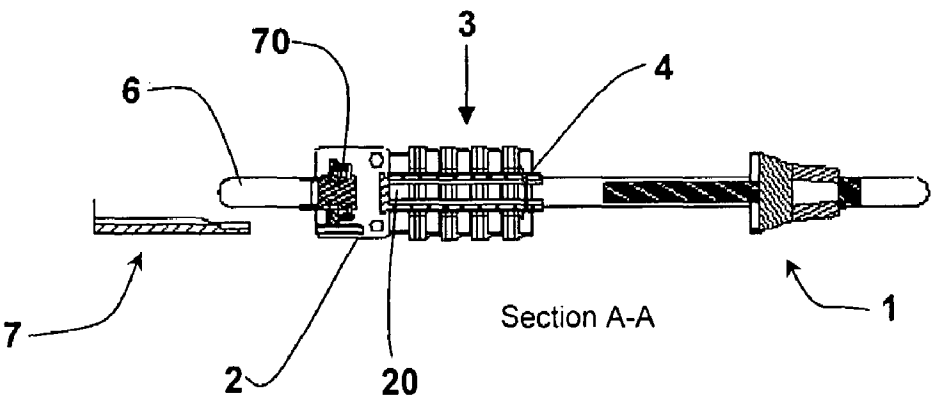
FIG. 1B is a sectional view of the lock as shown in FIG. 1A.
Figure 1C:
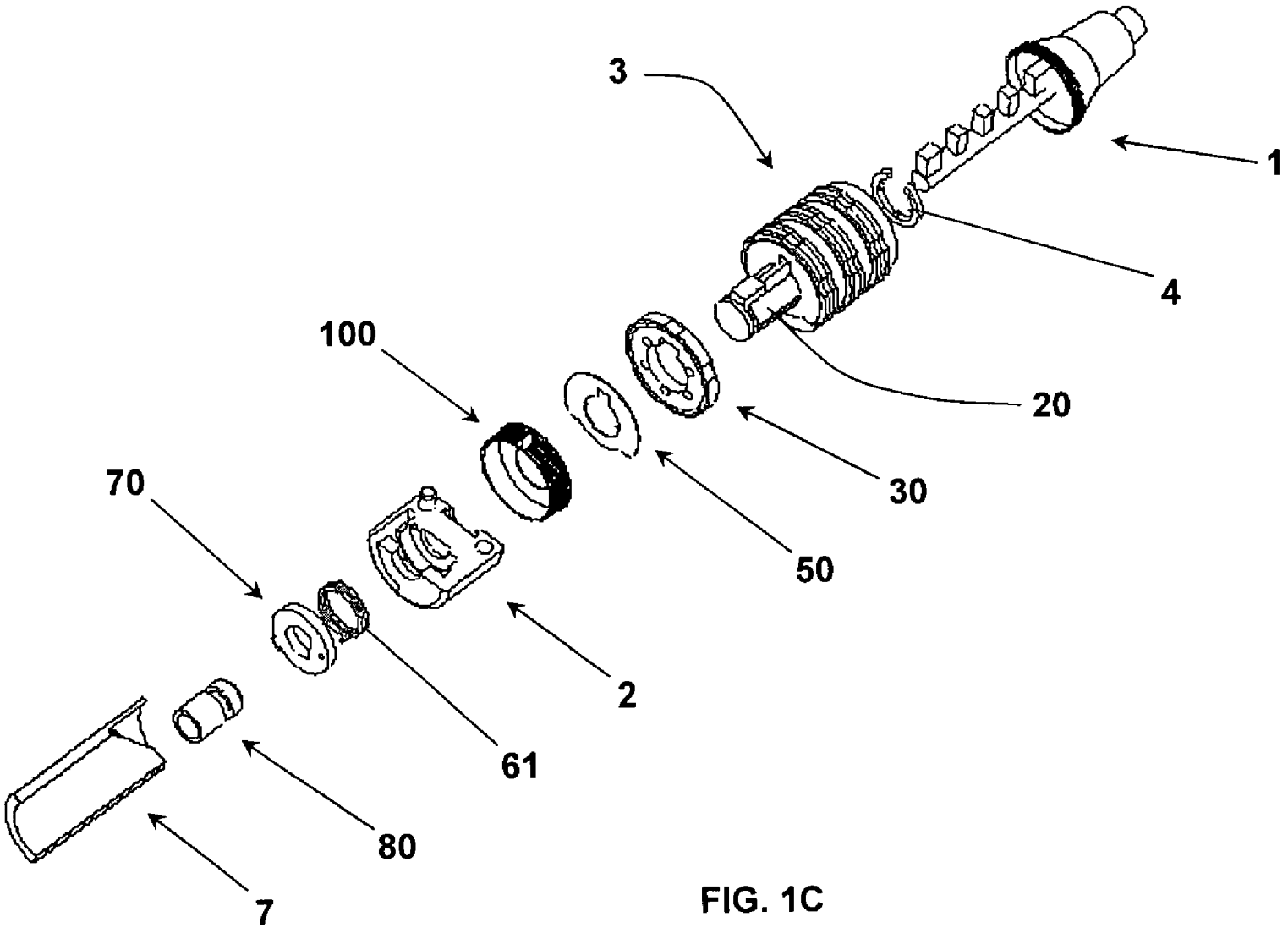
FIG. 1C is an exploded view of the lock as shown in FIG. 1A.
Figure 2E:
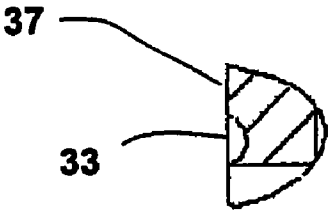
FIGS. 2A-E are component views of the notched numerical dials as shown in FIG. 1 that form part of the locking mechanism of the preferred embodiment.
Figure 2D:
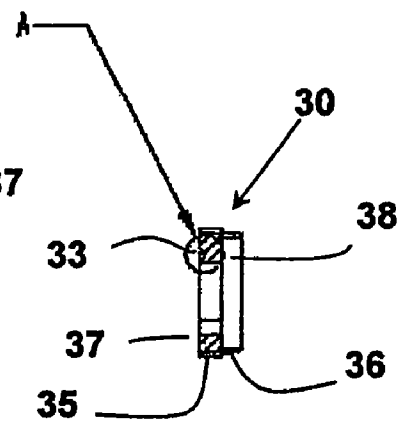
Figure 2C:
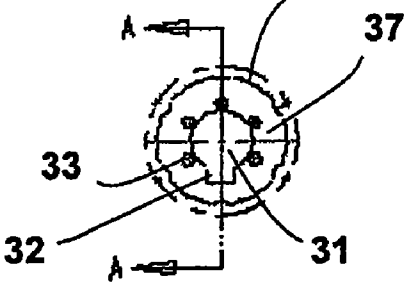
Figure 2B:
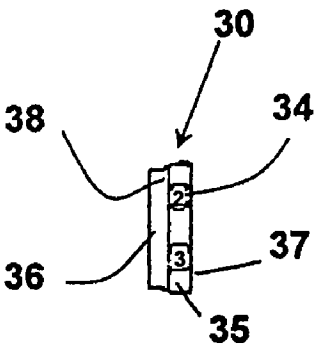
Figure 2A:
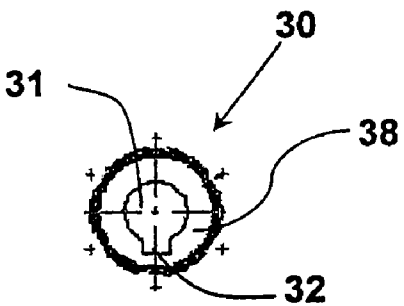

Referring to the figures, the preferred embodiment is showed in FIGS. 1A-C. The lock consists of a cable 6, which is permanently attached at one end to a key 1. The other end of the cable 6 is attached to a lock core housing 2, which in turn holds a hollow core shaft 20 in place. A lock assembly 3, formed from a plurality of numerical dials 30 interleaved with an equal number of tabbed washers 50, is fitted onto the shaft 20. The lock assembly 3 is held in place on the shaft 20 by affixing a retaining clip 4 onto the end of the shaft 20 distal from the core housing 2. The cable 6 is attached to the key 1 by fastening means that are well known in the art. The cable 6 is attached to the core housing 2 by inserting a swage key 80, which is permanently affixed to the end of the cable 6, into the end of the core housing 2 where a securing mechanism housed therein locks the cable 6 into place. The cable 6 may be removed by inserting the master unlock key 7 into the end of the core housing 2, thereby disengaging the securing mechanism and releasing the cable 6. An alternative embodiment has the securing mechanism embedded into the end of key 1, where the key is comprised of a separate key shaft secured into a key housing, and core housing 2 and shaft 20 comprising a single, unified, cast piece.

FIGS. 2A-D depict the numerical dials 30 which form a part of the lock assembly 3. Each dial 30 is disc-shaped, possessing a first surface 37, a second surface 38, a third essentially circular surface 35 running perpendicular to the first surface 37 and the second surface 38 and defining the outermost circumference of the dial 30, and a circular flange 36 normal to and extending from the second surface 38, concentrically inset from the circular surface 35. A center hole 31 is positioned concentrically in and runs perpendicular to the first surface 37 and the second surface 38. A notch 32 radially extends from the center hole 31 and is sized to an identical width as channel 22 and a height sufficient to just accommodate locking lugs 12*a*, 12*b*, 12*c*, and 12*d*. The center hole 31 is sized so as to allow the dial 30 to slide onto the shaft 20 and spin freely in place, but with minimal play. The circular flange 36 should extend from the second surface 38 a distance at least equal to the length of one of the corresponding locking lugs 12*a*, 12*b*, 12*c*, or 12*d*, less the thickness of a tabbed washer 50. Disposed and equally spaced upon circular surface 35 are a plurality of numbered concave depressions 34 equal to and corresponding with the number of stops on the numbered dial 30. A unique symbol, number, or other identifying mark is affixed to each concave depression 34 to facilitate entry of the lock's preset combination. A series of small round depressions 33, located on the first surface 37, equal in number to the number of stops on the numbered dial 30, and equally spaced around and radially positioned adjacent to the center hole 31, engage a protrusion 54 on each interleaved tabbed washer 50, thereby providing a positive stop for each depression 34.

Figure 3B:
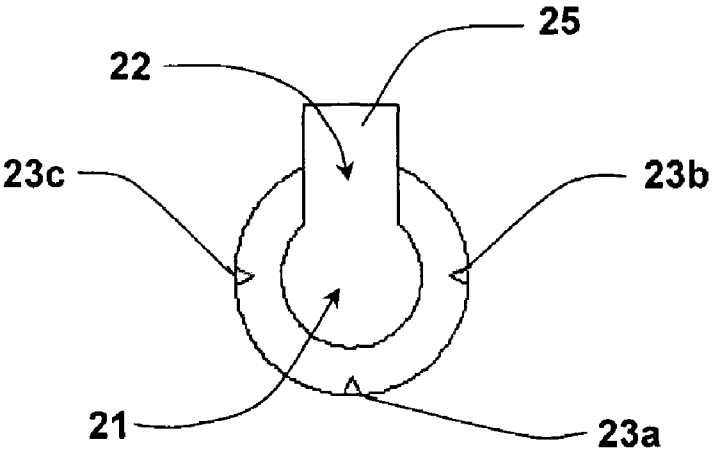
FIGS. 3A-C are component views of the lock core as shown in FIG. 1 that forms part of the locking mechanism of the preferred embodiment.
Figure 3C:
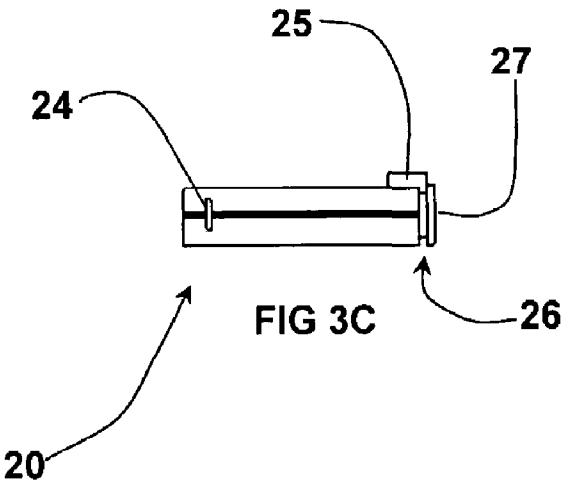
Figure 3A:
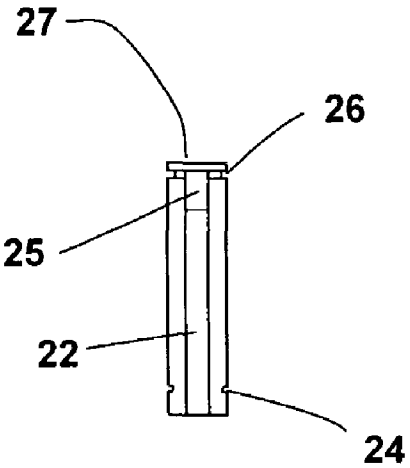
Figure 4B:
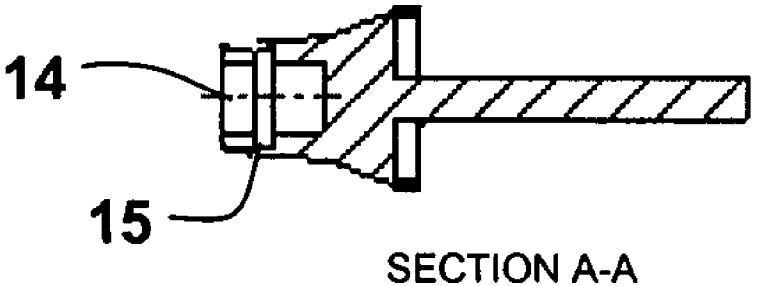
FIGS. 4A-D are component views of the key as shown in FIG. 1 that forms part of the locking mechanism of the preferred embodiment.
Figure 4A:
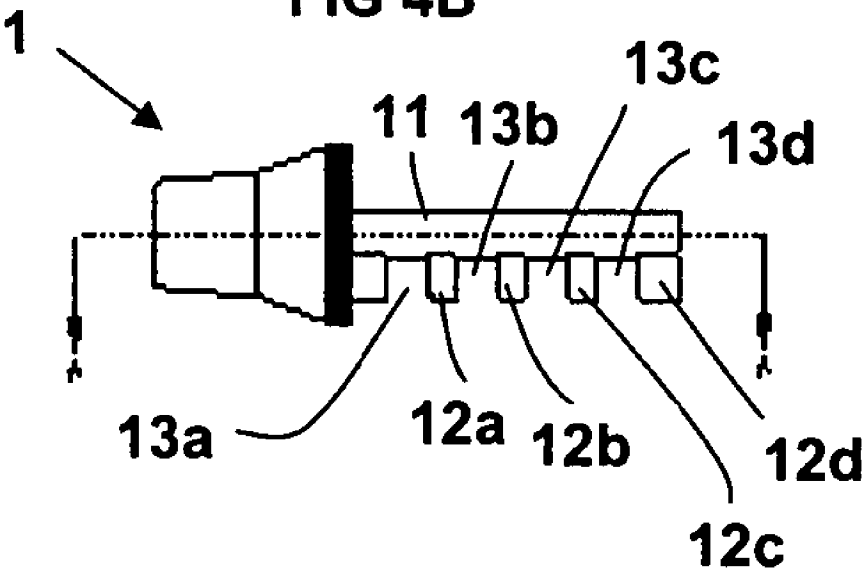
Figure 4C:
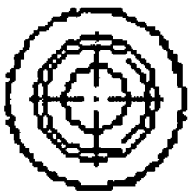
Figure 4D:
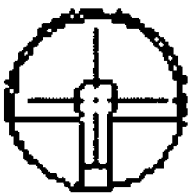

The lock core of the preferred embodiment is built upon a core shaft 20, depicted in FIGS. 3A-C. The core shaft 20 is tubular in shape, possessing a center bore 21 and at least one radially disposed channel 22 that runs the length of the core shaft 20. Core shaft 20 is of a length sufficient to accommodate the complete lock assembly 3 and ensure it is held fast with a minimal amount of play along the length of shaft 20 when the shaft 20 is secured into the core housing 2 and retaining clip 4 is affixed. The center bore 21 is sized and shaped to just accommodate key shaft 11 with a minimal of play, while the channel 22 is sized to accommodate the protruding locking lugs 12*a*, 12*b*, 12*c*, and 12*d*. Also radially positioned around the circumference of core shaft 20 are a plurality of notches 23*a*, 23*b*, and 23*c* positioned so as to engage an equal number of protrusions 53 on each tabbed washer. The core shaft 20 is attached to the core housing 2 by fitting the two halves of the core housing 2 around notch 26 and flange 27 on shaft 20. The lock assembly 3 of interleaved numerical dials 30 and tabbed washers 50 are secured in place on the core shaft 20 by use of retaining clip 4, which is positioned in groove 24. Ideally the core shaft 20 as depicted in FIGS. 3A-C is fabricated as a single piece of cast aluminum, to ensure simplicity, light weight, and low cost.

In FIGS. 4A-D the key 1 consists of a key shaft 11 of a diameter sized to fit within the center bore 21 of the core shaft 20. Radially disposed along the length of the key shaft 11 are locking lugs 12*a*, 12*b*, 12*c*, and 12*d*, separated from each other by spaces 13*a*, 13*b*, 13*c*, and 13*d*. The lugs 12*a*, 12*b*, 12*c*, and 12*d* are radially positioned and each sized so as to engage channel 22 of the core shaft 20 and when fully inserted into the lock assembly 3 fit within the space between the numerical dials 30 created by each flange 36. The spaces 13*a*, 13*b*, 13*c*, and 13*d* are each sized so as to accommodate the thickness of a numerical dial 30 as measured between the first surface 37 and the second surface 38. Key 1 may be permanently attached to the end of cable 6 by crimping a barbed fitting onto the end of cable 6 and inserting the end into cavity 14, where the barbed fitting can engage channel 15; however, any method which allows for the permanent and secure attachment of key 1 onto the end of cable 6 is appropriate and in keeping with the scope of the invention. Should a different attachment method be utilized, cavity 14 and channel 15 may be modified or omitted, as appropriate. Ideally the key 1 as depicted in FIGS. 4A-D is fabricated as a single piece of cast aluminum, to ensure simplicity, light weight, and low cost.

Figure 5C:
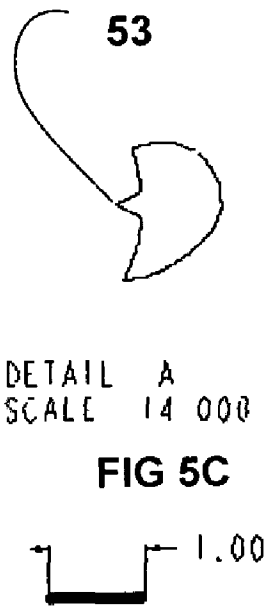
FIGS. 5A-C are component views of the tabbed washers as shown in FIG. 1 that form part of the locking mechanism of the preferred embodiment.
Figure 5B:
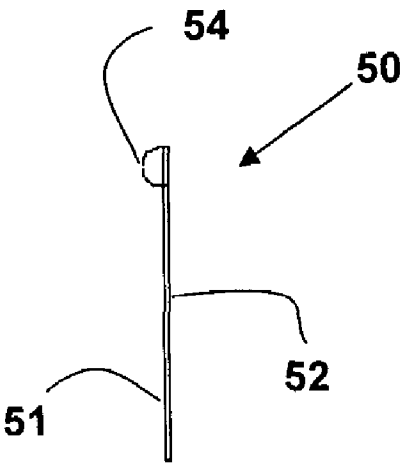
Figure 5A:
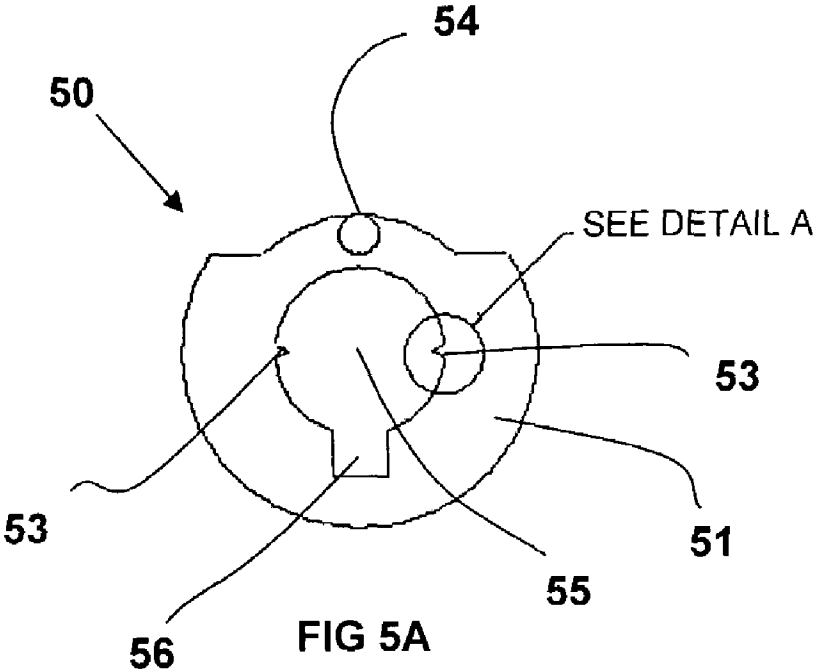
Figure 6A:
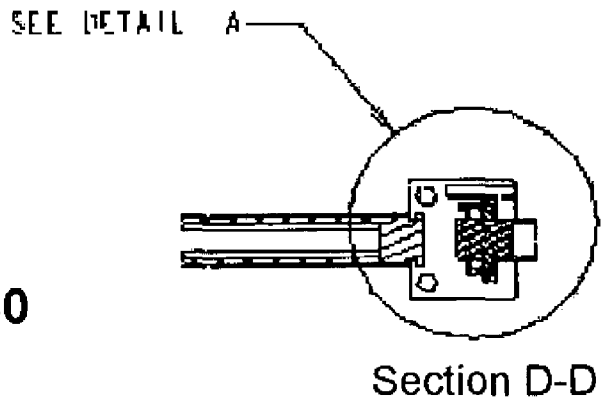
FIGS. 6A-C are component and sectional views of the assembled lock core end housing as shown in FIG. 1 and lock core as shown in FIG. 3 that form part of the locking mechanism of the preferred embodiment.
Figure 6B:
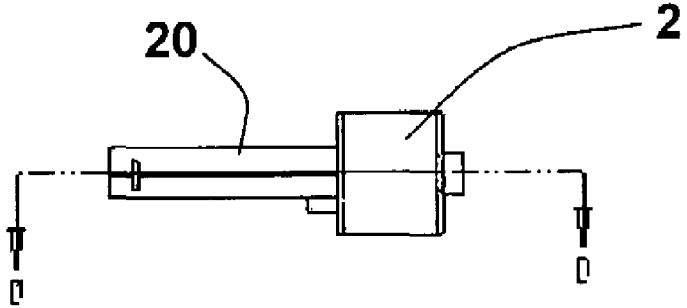
Figure 6C:
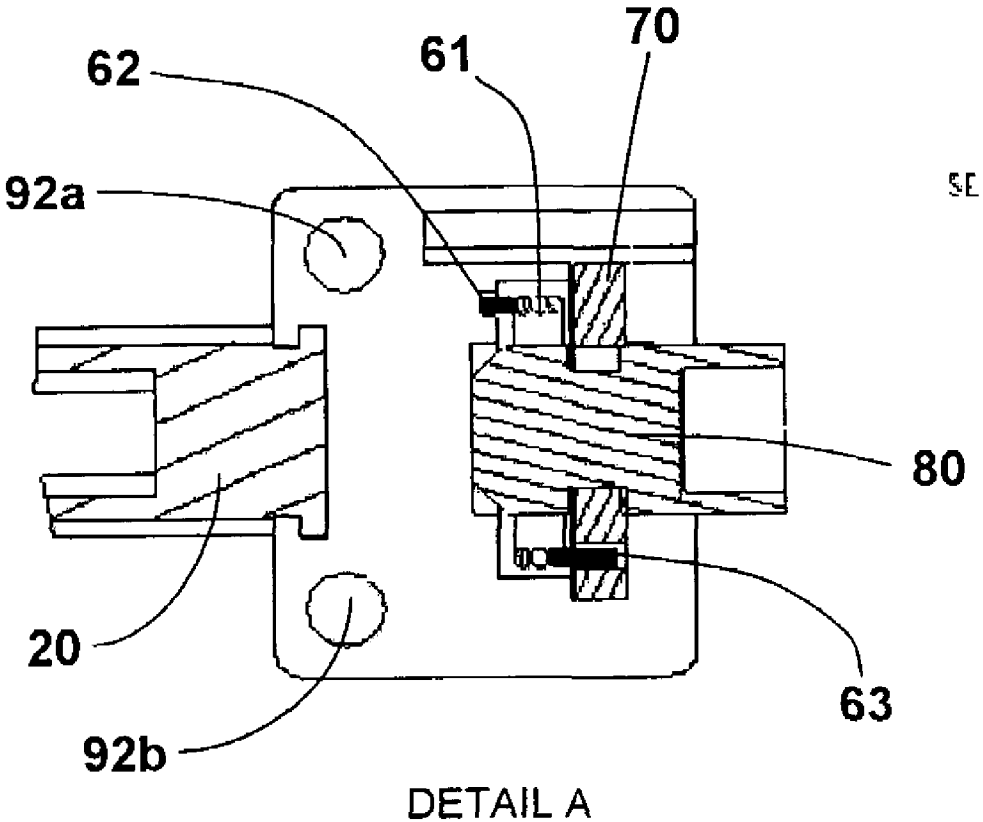

FIGS. 5A-C depict the tabbed washers 50. Each washer 50 is roughly disc-shaped, possessing a first surface 51 in a second surface 52. A center hole 55 is concentrically centered and runs perpendicular between the first surface 51 and the second surface 52. A notch 56 radially extends from the center hole 55 and is sized to an identical width as channel 22 and a height sufficient to just accommodate locking lugs 12*a*, 12*b*, 12*c*, and 12*d*. The center hole 55 is sized so as to allow the washer 50 to slide onto the core shaft 20 with minimal play. A plurality of protrusions 53 are radially disposed around the circumference of the center hole 55 and placed so as to engage notches 23*a*, 23*b*, and 23*c* on the core shaft 20, thereby fixably placing notch 56 in line with the channel 22 and preventing the washer 50 from rotating around the core shaft 20. A second protrusion 54 engages depressions 33 on numerical dial 30 so as to provide positive detents for each numbered depression 34 on numerical dial 30. Tabbed washer 50 is ideally machined from steel for enhanced durability.

Figure 7B:
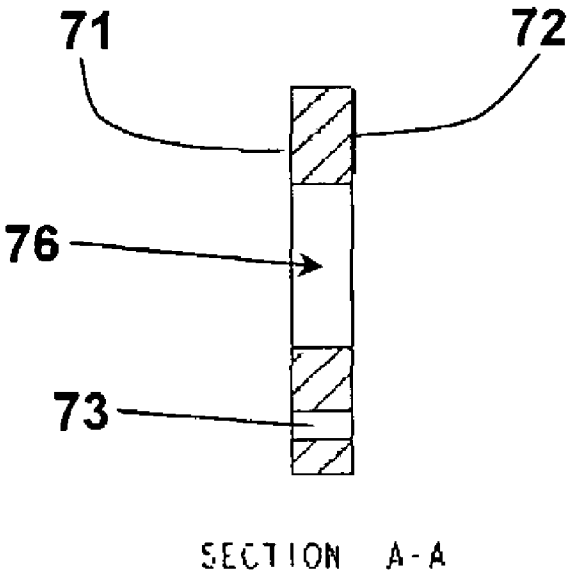
FIGS. 7A and B are component views of the cammed locking washers disposed inside of the lock core end housing shown in FIG. 6 that form part of the locking mechanism of the preferred embodiment.
Figure 7A:
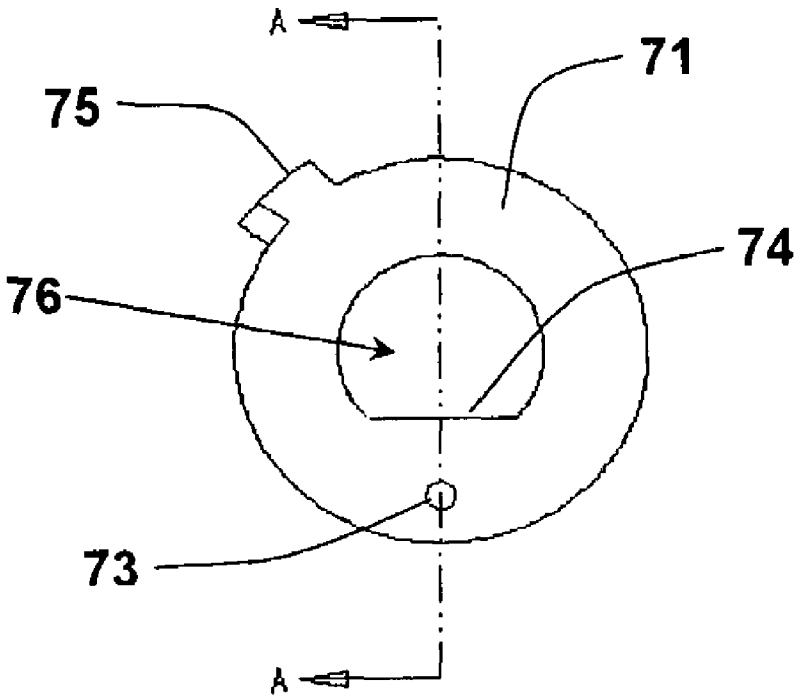
Figure 8B:
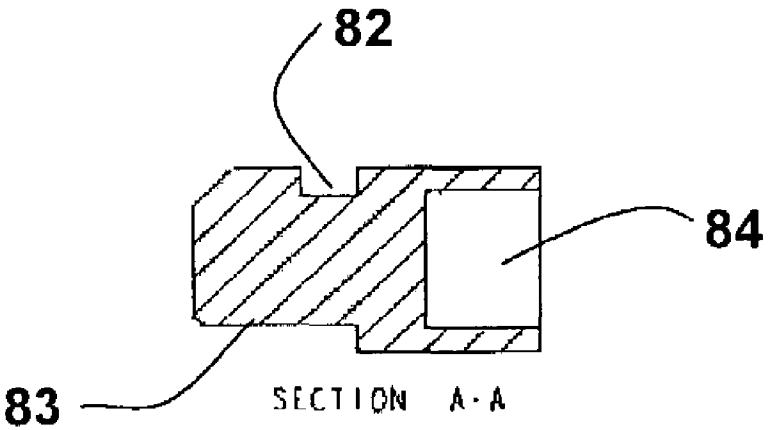
FIGS. 8A and B are component views of the swaged key fixably attached to the end of the cable as shown in FIG. 1 that forms a part of the locking mechanism of the preferred embodiment.
Figure 8A:
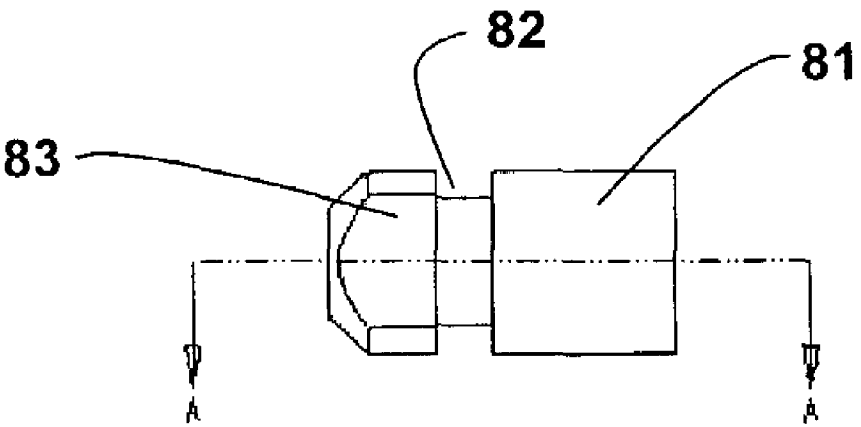
Figure 9A:
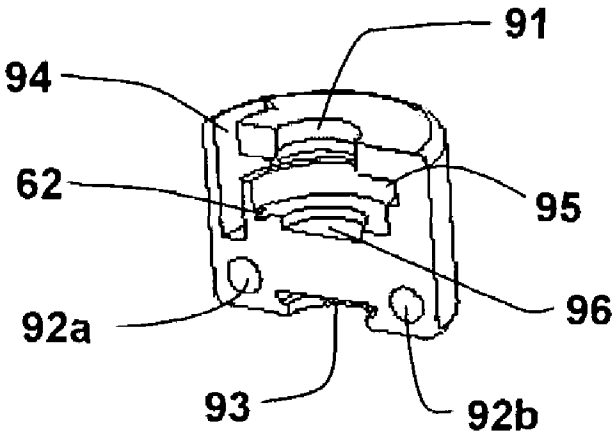
FIGS. 9A-D are component views of a lock core end housing half as shown in FIGS. 1 and 6 that form part of the locking mechanism of the preferred embodiment.
Figure 9D:
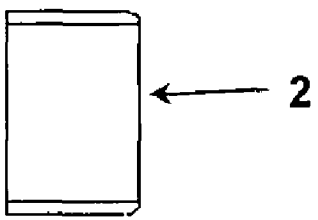
Figure 9B:
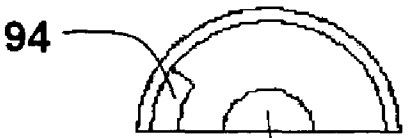
Figure 9C:
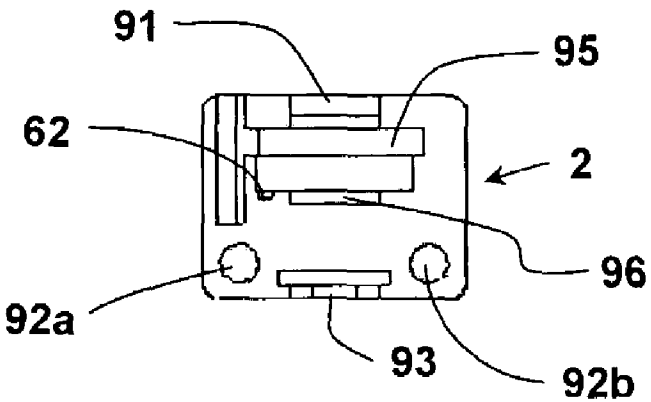

The cable 6 is secured to the lock core housing 2 through a securing mechanism contained in the end of the lock core housing as depicted in FIGS. 6 through 9. Turning to the figures which show the preferred embodiment of the securing mechanism as assembled into the core housing 2 and its working components, swage key 80, permanently affixed to one of the ends of cable 6, is inserted into aperture 91, where it makes contact with locking disc 70. Increasing pressure on the swage key 80 results in the locking disc 70 rotating to accommodate the swage key flat 83. Once the swage key flat 83 passes the locking disc 70, circular spring 61 forces the locking disc 70 to rotate back around the swage key 80 through the swage key locking channel 82, thereby securing the cable 6 to the core housing 2. Turning to FIG. 8, the swage key 80 is permanently affixed to the cable 6 by inserting an end of the cable 6 into the swage key end cavity 84, then crimping the swage key barrel 81 onto the cable 6.

Details of the locking disc 70 are depicted in FIG. 7. The locking disc 70 is roughly disc-shaped, possessing a first surface 71 and a second surface 72. A center hole 76 is concentrically centered and runs perpendicular between the first surface 71 and the second surface 72. The circular spring 61 engages hole 73 to allow the spring 61 to rotate the disc 70 into a locked position. The disc 70 secures the swage key 80 in place by use of a flat 74 that corresponds to swage key flat 83. As the swage key flat 83 passes the disc flat 74, the circular spring 61 rotates the disc flat 74 out of alignment with swage key flat 83, and into swage key locking channel 82. A cam lug 75 extending radially from the outer circumference of the disc 70 engages the master unlock key 7, which thereby forces the disc 70 to rotate against the tension of circular spring 61, bringing flat 74 back into alignment with swage key flat 83, and thereby allowing removal of the swage key 80 from the core housing 2.

The core housing 2 is depicted in greater detail in FIG. 9, and is assembled from two mirrored halves. The swage key 80 is inserted into aperture 91, which is shaped so as to accommodate the cross-sectional profile of the swage key 80 as taken from the portion of the key possessing the flat 83, thereby preventing the swage key 80 from rotating within the aperture 91. Alternatively, recession 96, located at the bottom of aperture 91, may be shaped so as to receive the tip of swage key 80 so modified in shape as to prevent the swage key 80 from rotating within the aperture 91. The locking disc 70 is placed into channel 95, with the circular spring 61 located immediately beneath it, as viewed in FIGS. 9A and 9C. One end of the circular spring 61 engages notch 62, to allow the spring 61 to be tensioned. An arc-shaped slot 94 is provided to insert the master unlock key 7, allowing access to the locking disc 70. End flange 27 and groove 26 on core shaft 20 fit into notch 93, to fixably secure shaft 20 to end housing 2. Once the shaft 20 and components of the mechanism to secure cable 6 are placed into one of the halves of end housing 2, the two halves are mated and permanently secured together by use of two drift pins placed into holes 92*a* and 92*b*.

Figures 10A, 10B, 10C:
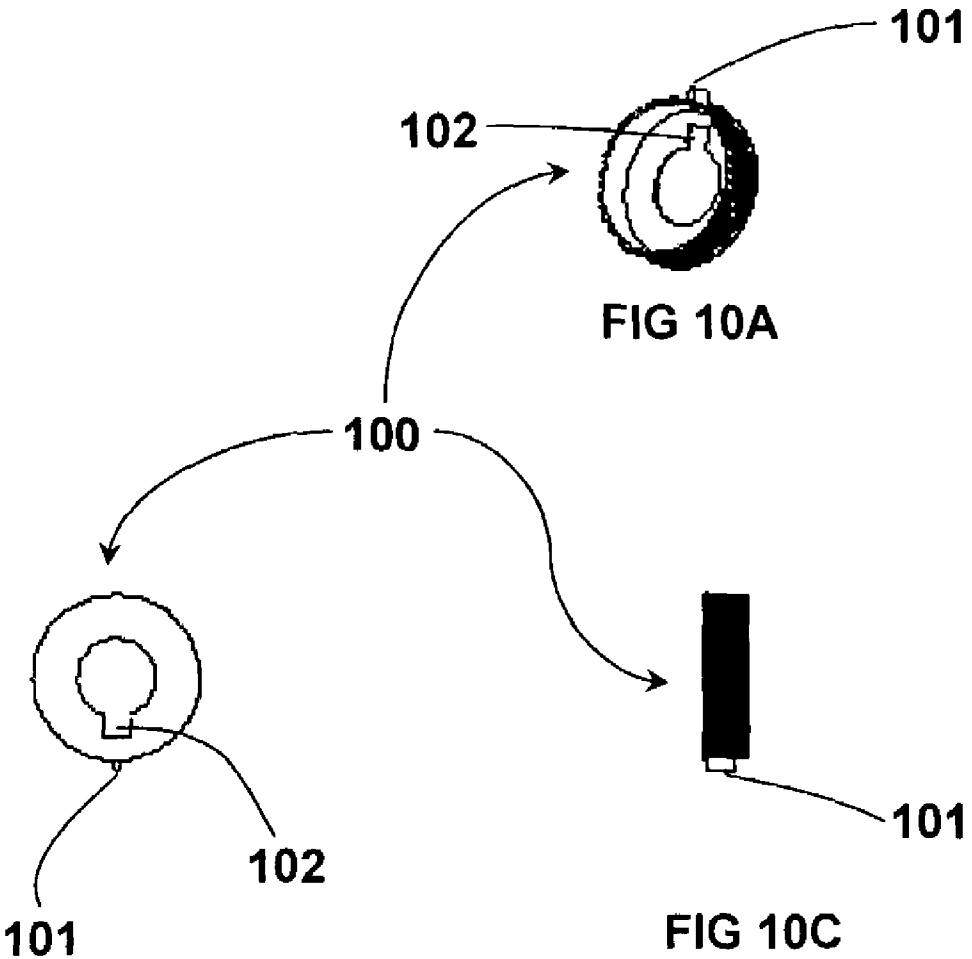
FIGS. 10A-C are component views of the numerical index ring as shown in FIG. 1 that forms a part of the locking mechanism of the preferred embodiment.

An index ring 100, depicted in FIG. 10, is slipped over the core shaft 20 to provide a fixed index mark 101 which serves as a reference for dialing the lock's unique combination into the numerical dials 30. The index ring 100 is fixed in place and prevented from spinning around the core shaft 20 by the presence of a notch 102, which is sized to just engage an index tab 25 with minimal play, located on the end of the core shaft 20 proximal to the core housing 2.

Figure 11B:
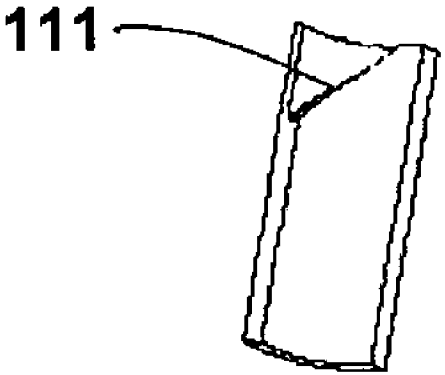
FIGS. 11A-C are component views of the cammed key used to effect removal of the swaged key as shown in FIG. 8 from the lock core end housing as shown in FIG. 6, useful with the locking mechanism of the preferred embodiment.
Figure 11C:
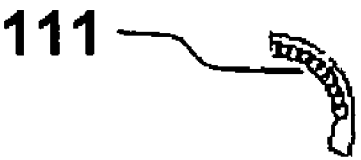
Figure 11A:
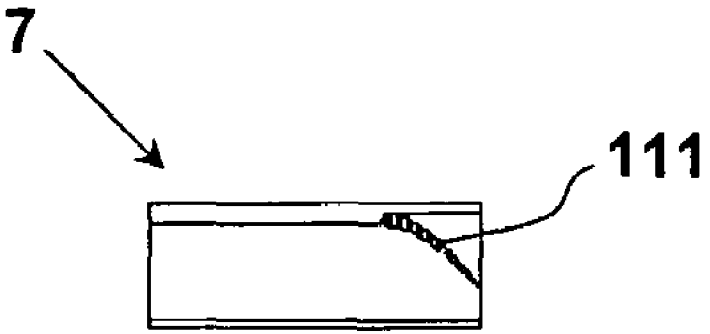

The master unlock key 7, depicted in FIG. 11, is fabricated from a single curved piece of metal, and is sized so as to just fit inside slot 94 on core housing 2. Into one end of the unlock key 7 a curve 111 is milled, and set partially into the inside curve of the key. This curve 111 engages cam lug 75 as described above, allowing for the quick opening of the lock.

To close the lock, the numerical dials 30 are turned to the lock's preset combination by lining up the appropriate numbered depressions 34 with index mark 101, which causes notches 32 to line up with channel 22. The key 1 is then inserted into the lock core shaft 20, where locking lugs 12*a*, 12*b*, 12*c*, and 12*d* fit into the spaces created by flanges 36. The numerical dials 30 are then turned to a combination other then the lock's preset combination, thereby securing the key 1 into the core shaft 20 as each notch 32 is rotated out of alignment with channel 22. The lock may be opened by resetting the numerical dials 30 to the lock's preset combination, and then pulling the key 1 from the core shaft 20.

The above embodiment is only used to illustrate one possible method of practicing the present invention, and is not intended to limit the scope thereof. A person having skill in the art will recognize changes that may be made thereto while still practicing the claimed invention.

We claim:

1. A cable padlock comprised of:

a cable having a first end and second end, a diameter no greater than ¼ inch, and a length no greater than 7 inches;

a key possessing a plurality of locking lugs radially positioned along its length, said lugs separated from each other by a plurality of spaces, said key being affixed to said first end of said cable;

a swage key permanently affixed to said second end of said cable;

a lock core housing comprised of two halves, said halves being mirror images of each other and fixably secured together;

an external master unlock key;

a means for receiving and securing said swage key to said lock core housing located within said lock core housing, and allowing for said swage key to be detached from said lock core housing by application of said external master unlock key;

a shaft having a hollow core and possessing one or more channels radially positioned and running the length of the shaft, said channels being positioned and sized so as to accommodate said plurality of lugs and facilitate insertion of said key inside said shaft, said shaft being affixed to said lock core housing;

a plurality of dials, each dial possessing a center hole sized so as to allow said shaft to pass through said center hole and allow said dial to freely rotate upon said shaft, one or more notches equal in number to the number of said channels on said shaft and radially extending from said center hole and sized so as to accommodate said plurality of lugs, and a plurality of uniquely marked concave depressions, where said shaft is inserted through said center hole of each dial; and a means to secure said dials upon said shaft.

2. A cable padlock as claimed in claim 1 wherein said dials each have at least five concave depressions.

3. A cable padlock as claimed in claim 1 wherein each said uniquely marked concave depression is marked with an Arabic numeral.

4. A cable padlock as claimed in claim 1 wherein said dials are interleaved with a plurality of washers equal to the number of said dials, said washers each possessing a center hole, one or more notches equal to the number of said channels in said shaft and radially extending from each said washer's said center hole and sized so as to accommodate said plurality of lugs, and said shaft is passed through said center holes of said interleaved washers and dials.

5. A cable padlock as claimed in claim 4 wherein:

each said washer has a surface perpendicular to the axis of said shaft, said washer surface having a first protrusion rising above the plane of said washer surface;

each said dial has a surface perpendicular to the axis of said shaft, said dial surface disposed opposite to said washer surface, and possessing a plurality of depressions arranged in a circular fashion upon said dial surface, said depressions located so as to engage said first protrusion;

each said washer's said center hole has a plurality of second protrusions positioned around the circumference of said washer's said center hole and protruding towards the center of said washer's said center hole; and said shaft has a plurality of notches positioned around the circumference of said shaft so as to engage said second protrusions and thereby prevent said washers from rotating about said shaft.

6. A cable padlock as claimed in claim 4 having at least five of said dials and five of said washers.

7. A cable padlock as claimed in claim 4 wherein said interleaved washers and dials are secured to said shaft with a retaining clip, which is fitted into a retaining groove positioned on the end of said shaft that is distal from the end where said shaft is affixed to said cable.

8. A cable padlock as claimed in claim 4 wherein said washers are manufactured from steel.

9. A cable padlock as claimed in claim 4 wherein said shaft has only one channel.

* * * * *